United States Patent [19]

Kauffmann

[11] 4,094,507

[45] June 13, 1978

[54] CHANNELED PIVOTING BALL GAME WITH SELECTIVE HOLE CLOSURE

[76] Inventor: Russell E. Kauffmann, 1604 Executive La., Glenview, Ill. 60025

[21] Appl. No.: 766,860

[22] Filed: Feb. 9, 1977

[51] Int. Cl.[2] ..... A63F 7/04; A63B 71/04

[52] U.S. Cl. ..... 273/110; 273/116; 273/113

[58] Field of Search ..... 273/110, 112, 116, 118 D, 273/122, 124, 123, 125, 113, 115

[56] References Cited

U.S. PATENT DOCUMENTS

| | | | |
|---|---|---|---|
| 669,576 | 3/1901 | Dixon | 273/123 R |
| 1,074,816 | 10/1913 | Randall | 273/116 |
| 2,117,080 | 5/1938 | Conover | 273/110 |
| 3,114,554 | 12/1963 | Hurley | 273/124 R |

FOREIGN PATENT DOCUMENTS

| | | | |
|---|---|---|---|
| 761,008 | 12/1933 | France | 273/122 R |
| 1,090,739 | 4/1955 | France | 273/110 |
| 606,920 | 8/1948 | United Kingdom | 273/116 |

*Primary Examiner*—Richard C. Pinkham

*Assistant Examiner*—Lawrence E. Anderson

*Attorney, Agent, or Firm*—Richard G. Kinney

[57] ABSTRACT

A table height rolling ball game apparatus of the type employing a freely tippable table whose upper surface has a maze defining a track on which a ball may freely roll is disclosed. The track runs circuously from an outer start position to a central end position and a number of hazard holes are provided in the track. The hazard hole and track are sized such as to allow the ball to roll past the hazard hole when rolling along one sidewall of the track, but to fall into and through the hole when proceeding along the other side of the track. At least some of the holes are placed along the side walls where the ball would naturally travel so as to require a coordinated action on the part of the player or players to avoid them. A novel hole closing system is employed to selectively close the hazard holes so that the game may be made easier or harder. Further, a restricted-movement free-wheeling wheel (to prevent torque applications) is provided for play by a team of two, wherein the pair of players must cooperate and coordinate their movements to position and move the table.

2 Claims, 6 Drawing Figures

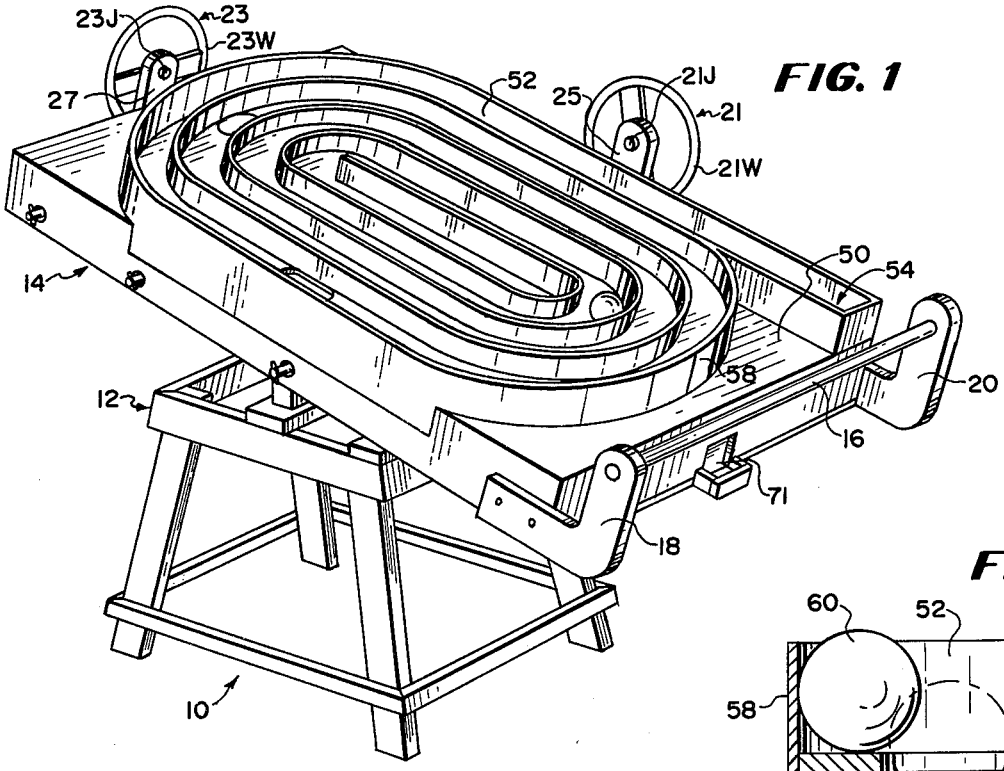
FIG. 1
FIG. 3
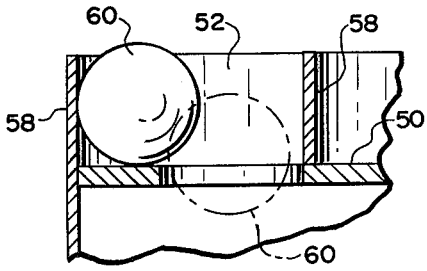
FIG 2
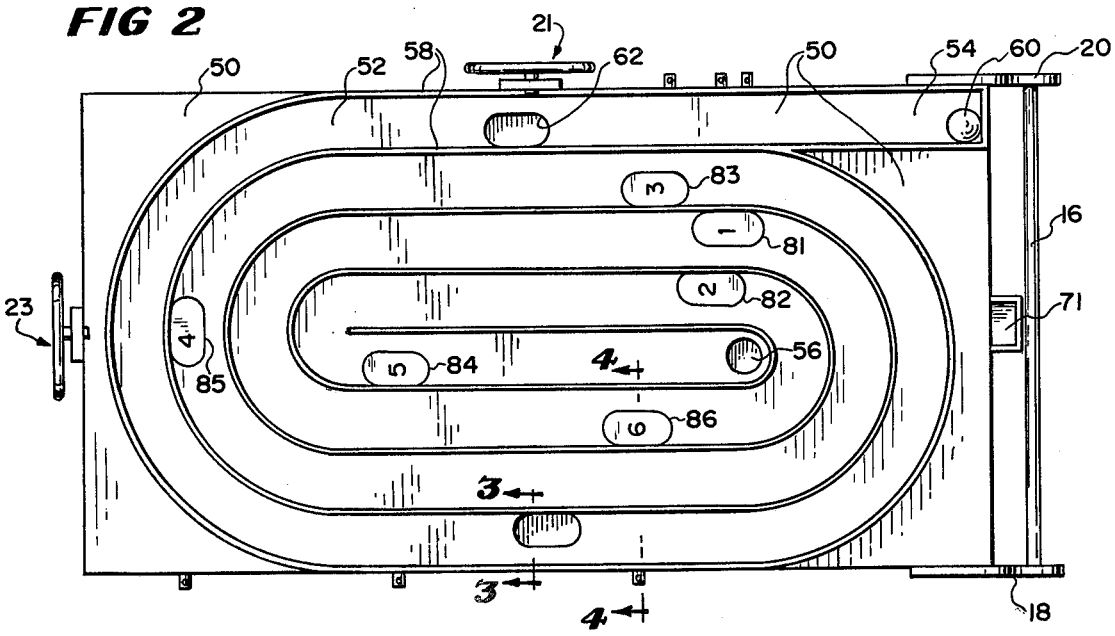

CHANNELED PIVOTING BALL GAME WITH SELECTIVE HOLE CLOSURE

FIELD OF THE INVENTION

The present invention is directed toward games apparatus and is particularly directed toward improvements in games of the general type wherein balls roll on a surface and wherein the surface is to be tipped or slanted to maneuver the ball.

SUMMARY OF THE INVENTION

A rolling ball game apparatus constructed in accordance with the principles of the present invention includes a tippable table top height unit having an upper surface on which are defined a spiralling track sized so as to be wider than the ball used on it. The unit has manual grips so that one or more players may tip the table to maneuver the ball on the surface and a plurality of selectively closable hazard holes, one or more of which may be alternatively latched closed by a manually operable means. These holes are sized and positioned to allow the ball to fall through them or to bypass them and continue along the track. This allows the game's difficulty to be decreased or increased by by alternatively manually latching in the closed or open position for the selected hole or holes.

BRIEF DESCRIPTION OF THE DRAWINGS

The present invention, together with further features and advantages thereof, can best be understood by reference to the following description taken in connection with the accompanying drawings, in the several figures of which like reference numerals identify like elements, and in which:

FIG. 1 is a perspective view of a rolling ball game apparatus incorporating the principles of the present invention;

FIG. 2 is a top view, of the game apparatus of FIG. 1.

FIG. 3 is a partial sectional view of one of the apparatus of FIGS. 1 and 2, showing a ball in one position and indicating another position for the ball in phantom lines, which view is useful in illustrating one feature of the present invention;

DETAILED DESCRIPTION

In FIG. 1, a game apparatus constructed in accordance with the present invention is shown and is generally designated by the numeral 10. The game apparatus 10 includes a base 12 and a movable upward facing table portion 14.

Figure 5:
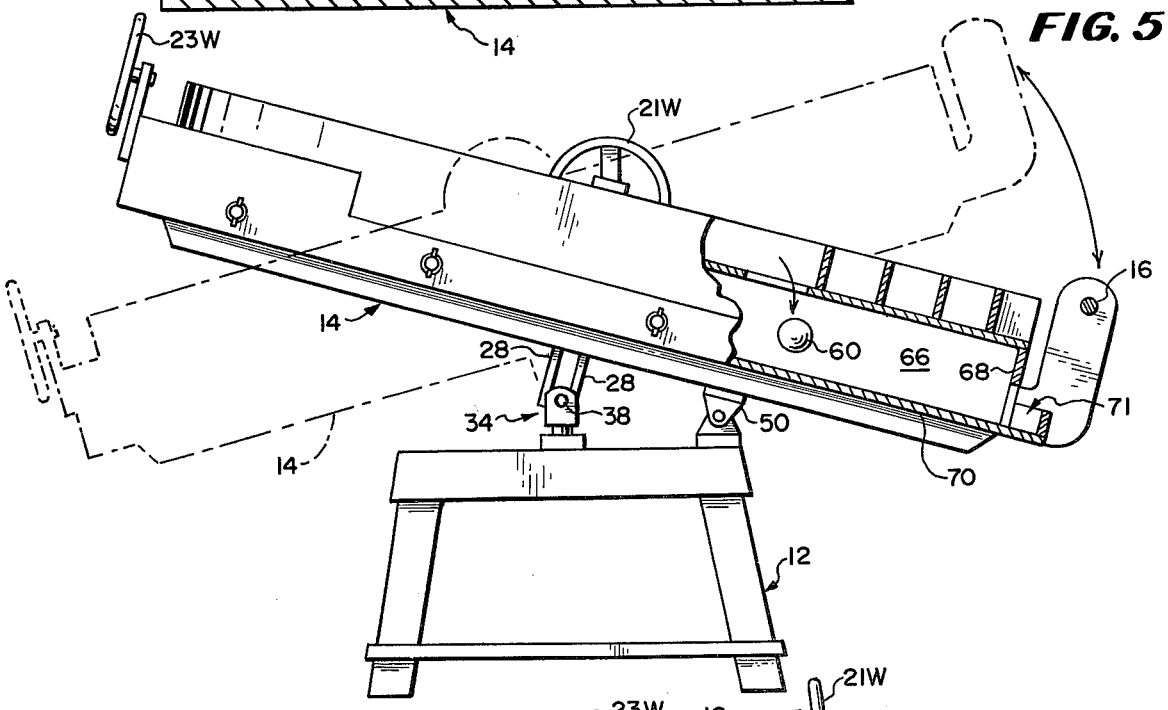
FIG. 5 is a side elevational view of the apparatus of FIGS. 1 - 4, partly broken away to illustrate interior parts and with a moved position of a part, the table portion, shown in phantom lines.

The table portion 14 is mounted at about waist height, on the base 12, in a manner that will be explained below, in such a way as to be manually tippable by one or more players. A single player may conveniently grip a handle bar 16. The bar 16 is mounted across one short end of the elongated table 14 and may be conveniently gripped by spreading apart both hands of a player standing and facing the table at that end. Bar 16 is long enough to comfortably accommodate the normal span between the arms of a single player so that each of his hands may grip the bar toward its ends (near standards 18, 20) so as to conveniently be able to make the table 14 "roll" a turn about a longitudinal-horizontal axis by pressing one hand up and the other down, as illustrated in FIG. 5. And by moving to his right or left, the player can cause the table to yaw or rotate about its vertical center axis.

In accordance with one feature of the present invention the table 14 is equipped with a roll control 21 and a pitch control 23, each of which are designed to be used by a single player when two players are using the game. The controls 21 and 23 are designed to prevent the player using them from applying torque to move the table in one major direction. More particularly, the controls 21 and 23 each consist of a wheel **21*w* or 23*w* which is free-wheeling journaled at 21J and 23J to standards 25 and 27, respectively. These standards are located at the midpoints of the longitudinal side and the transverse side of the table 14 and thus the axis of the wheels 21*w* and 23*w* lies approximately over the pivot axes of the table 14**.

Figure 6:
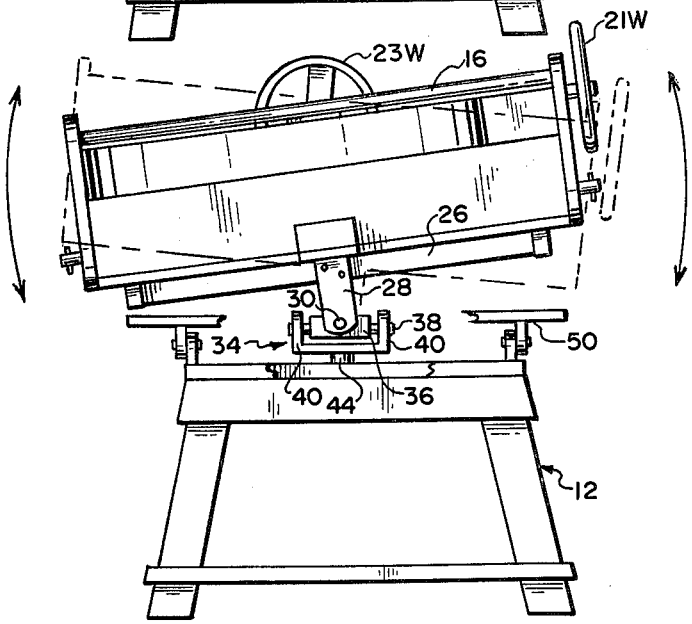
FIG. 6 is an end elevational view of the apparatus of FIGS. 1 - 5, with some parts broken away to show other parts more clearly and with a moved position of the table portion shown in phantom lines.

This can be better seen in FIGS. 5 and 6. With reference to FIG. 5, it can be seen that the pitch of table 14 may be changed by a player gripping the wheel **23*w*, by advancing it up and down, but that a player gripping the wheel, since he cannot transfer any torque to the table by turning the free-wheeling wheel 23*w* and since the axis of the wheel 23*w* is close to a pitch axis at 38, the player gripping the wheel 21*w* can not effectively change the pitch of the table. Thus only the player gripping 23*w*** can effect the pitch.

For similar reasons as can be seen from FIG. 6 the player gripping wheel **21*w* can make the table roll but the player gripping wheel 23*w*** cannot.

Of course, in any normal play the table will be moved in a combination of both pitch and roll to move the ball, and cooperation and coordination by the players gripping **21*w* and 23*w*** are therefor needed.

Figure 4:
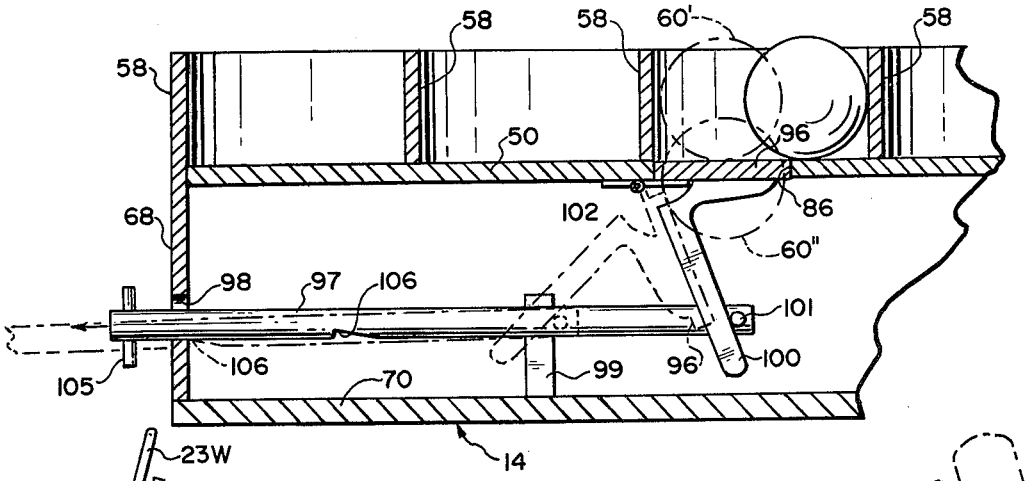
FIG. 4 is another partial sectional view, of the apparatus of FIGS. 1 and 2, with a ball and other parts' moved positions shown by phantom lines.

A gimbals arrangement designated 24 is shown in FIGS. 4 and 5. A centrally located cross-span 26 is provided and at the center of this is provided a pair of depending arms 28, which are spaced apart by the thickness of cross-span 26, and have a pivot pin 30 between them. Although this particular mechanism 34 is presently preferred because of its ease of construction other equivalent mechanisms can, of course, be used. The main object of such a mechanism is to support the table 14 in such a manner as to allow the player or players to move it in any desired combination of the three described manners: yaw, pitch or roll.

The gimbals 34 also include a cross piece 36 in which the pivot pin 30 and a pair of pivot pins 38 on a common axis and are journaled in standards 40 which form part of a U-shaped arrangement which also has a pivot pin 44 which is aligned below the pivot 30. The pin 44 is journaled in a receiving opening in the base 12 and serves to allow the U-shaped member 4 the entire table 14 to yaw on the base about the vertical axis at about the center of the table. The pivot between the U-shaped member including the standard 40 and the cross piece 36 allows the table's pitch to be varied and the pivot of pin 30 allows the table to roll.

The table 14 is so balanced as to be slightly weighted toward the handle 16 and a simple support 50 is provided on the base so as to receive the bottom of the table 14 in its rest position as shown in FIG. 1.

The gimbals arrangement 34, base 12 and rest 50 may be essentially similar to those shown and described in the copending U.S. Patent Application filed by the present inventor on Dec. 6, 1976, Ser. No. 747,705 entitled "Rolling Ball Game Apparatus." Indeed it is one of the advantages of the present game apparatus that the table 14 may be used on the same base as that game.

Referring now to FIGS. 1 and 2, the table 14 will be described in more detail. The table 14 has a planor upper surface 50 upon which is found a track 52 which runs from a start area 54 to a goal or end area 56. The track 52 is of decreasing ovals in shape and is formed by up-standing sidewalls 58.

The surface 50 is provided with hazard holes such as the hole 62 and the track width, ball and hole size are so related as to allow the ball either to fall completely through the hazard hole or to roll by it as illustrated in FIG. 3. The holes, with the exception of the finish hole 56, are oval in outline, with the long oval axis paralleling the track course, to prevent a fast moving ball from jumping over them.

As best seen in FIG. 5, the ball falls into an area 66 enclosed by the side walls 68 and bottom 70 and from which it can be removed at a ball return exit 71. The interior of the area 66 is preferably constructed so that a ball 60 will naturally roll to the ball return 71 when the apparatus is put into its rest position (FIG. 1 and solid lines in FIG. 5).

In accordance with a feature of the present invention the surface 50 is provided with hazard holes 81, 82, 83, 84 and 85 and means for selectively closing these holes. With reference to FIG. 4, these means may be a plug 96 (preferably bearing an indicia such as the "6" shown in FIG. 2) which is mounted for movement between a closed position wherein it fits in and closes the hole 86 to provide a smooth surface there, across and over which a ball (such as the ball "60") may roll, and an open position, shown in phantom lines in FIG. 4, wherein it is removed from the hole 86 (so that a ball "60" may fall through the hole). The plug 96 is normally operated by means of a horizontal lever arm 97 which is moved in and out of the side wall 68 by a player. The lever arm 97 glides in a hole 98 formed in the sidewall 68 and an up-standing guide 99 mounted on the floor 70. An arm 100 is attached to the lever 97 by means of a peg 101 and a spring hinge is provided at 102. A simple cross member 105 at the end of the arm 97 may be provided to aid in gripping; and a notch 106 is provided in the arm 97 for holding the arm in the open position.

Operation: By lifting, lowering, tilting and rotating the movable game table 14, the player or players roll the ball from its position at "Start" 54, through the continuous channel or track 52 until it falls into "Finish" hole 56, if they avoid open holes such as the hole 62, in the track. The goal is to complete this in as little time as possible.

Ways of playing a game with the apparatus 10 will now be discussed:

Single Player: A single player controls the table with handle 16. Game may begin with all holes 81 - 86 closed (except the three which cannot be closed), with the table in "Rest" position (FIG. 1) and with the ball at "Start" 54.

When the signal to begin is given by a timekeeper, player rolls the ball through the channel and into the "Finish" hole 56. He lowers the table to "Rest", retreives the ball from the "Return" slot, places it at "Start", opens #1 hole 81, and again rolls the ball through the channel and into the "Finish" hole. He lowers the table to "Rest", retreives the ball, places it at "Start", opens #2 hole 82 (leaving hole 81 open), and repeats. Holes are opened one at a time, in numerical order, and are left open. The game is over and time transpired is noted, when the ball drops into the "Finish" hole after holes 1 through 6 have been opened.

Should the ball drop into a hole other than the "Finish" hole, the table is lowered to "Rest", the ball retrieved and started and play continues. Time keeps going when this occurs. Again the opened holes are kept open.

"Score" is the time required to roll the ball seven times through the channel, without dropping it into any but the "Finish" hole.

Partner Play: Wheel grips 21 and 23 are used to control the table when partners play. (Handle "16" is not used in partner play.)

Player at wheel grip 23 controls the pitch or longitudinal movement of the table. Player at wheel grip 21 controls the roll or latitudinal movement of the table. Players must coordinate their control of the table to speed the ball through the channel and to avoid holes.

The player at the grip 21 opens holes #1, #2, and #3 at appropriate times, retreives the ball and places it at "Start". The player at grip 23 opens holes #4, #5, and #6 at appropriate times.

Directions for rolling the ball through the channel and for opening the holes in numerical order, and for procedures when the ball drops into a hole are the same as those for the single player.

Partners try to complete the game in less time than their pair of opponents.

Of course other games may be played. One ball may be played by each side and the times compared. The closable hazard holes 81 - 86 may be used to handicap players or teams during play. For example, a skilled player may have all holes open when he takes his turn, but a child or unskilled player may have them all closed during his turn.

It should be understood that by pitch and roll herein and in the claims, any two substantially displaced horizontal axes through approximately the center is meant. That is the wheel grips 21 and 23 may be positioned at different places than those shown (e.g., at the corners of the table) and the same effect achieved.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A rolling ball game apparatus comprising in combination, a table top height unit having an upper surface of approximately rectangular overall shape and on which is defined spaced apart walls which form a continuous spiralling track from a start position to a finish position, said track being sized such that it is generally wider than the ball so that the ball may roll over different paths while proceeding along the track;

means for mounting the table top height unit at that height such that the unit may be tipped about a central area in any direction and its strike plane changed, and manual grip means for allowing one or more players to control the dip and strike of the table unit;

said table top unit surface also defining a plurality of hazard holes spaced about the track and so sized as to allow a ball to fall through them and positioned such as to allow a ball to travel past the hole without falling in it;

means provided in the unit for selectively closing alternatively one or more different ones of the plurality of holes such that a ball will roll over the closed holes without material interuption, said means being selectively manually operable from the edge of the unit to alternatively latch in the closed or open position the selected hole or holes whereby one or more players may attempt to control the dip and strike of the table top height unit to maneuver a ball past hazard holes and along the spiralling track from start to finish, and the game's difficulty may be increased by alternatively manually latching in the closed or open position the selected hole or holes.

2. The apparatus of claim 1 wherein the holes are in shape elongated in the direction of the track so as to prevent a fast ball from jumping over them and the means for closing them includes a conformingly shaped surface which is latched into closed position wherein it is parallel to the surface.

* * * * *